United States Patent [19]

Takamatsu

[11] 4,048,698

[45] Sept. 20, 1977

[54] SEMIPERMANENTLY LOCKABLE SLIDER

[75] Inventor: Ikuo Takamatsu, Uozu, Japan

[73] Assignee: Yoshida Kogyo Kabushiki Kaisha, Japan

[22] Filed: Dec. 17, 1975

[30] Foreign Application Priority Data

Dec. 21, 1974 Japan ..... 49-155898[U]

[51] Int. Cl.[2] ..... A44G 19/30

[52] U.S. Cl. ..... 24/205.14 R

[58] Field of Search ..... 24/205.14 R, 205.14 K, 24/205.15 R, 205.1 R

[56] References Cited

U.S. PATENT DOCUMENTS

| | | | |
|---|---|---|---|
| 1,967,137 | 7/1934 | Sundback | 24/205.14 R |
| 2,045,626 | 6/1936 | Winterhalter | 24/205.14 R |
| 2,077,360 | 4/1937 | Gilmore | 24/205.14 R |
| 2,532,367 | 12/1950 | Lyeth | 24/205.14 R |
| 2,575,187 | 11/1951 | Schaye | 24/205.14 R |

FOREIGN PATENT DOCUMENTS

| | | | |
|---|---|---|---|
| 590,076 | 1/1960 | Canada | 24/205.14 R |
| 831,423 | 9/1938 | France | 24/205.14 R |
| 583,256 | 8/1933 | Germany | 24/205.14 R |
| 1,806,239 | 5/1970 | Germany | 24/205.14 R |
| 478,870 | 3/1953 | Italy | 24/205.15 R |

*Primary Examiner*—Bernard A. Gelak
*Attorney, Agent, or Firm*—Bucknam and Archer

[57] ABSTRACT

For semipermanently locking a slider in a fully closed position on interlockable rows of fastener elements, a locking pawl is formed integral with one of the wings of the slider for engagement with the fastener elements received therein. The locking pawl may either automatically lock the slider against movement in its closed position or be pincered into the slider at the end of its fastener closing movement.

1 Claim, 7 Drawing Figures

SEMIPERMANENTLY LOCKABLE SLIDER

BACKGROUND OF THE INVENTION

This invention relates to slide fasteners, and in particular to slide fasteners adapted for unopenably closing openings in upholstery coverings of chairs, sofas and like articles. Even more particularly, the invention deals with improvements in a slider for use in such fasteners.

The slide fasteners employed for the above application have usually been provided with sliders of the automatically locking or cam-locked type, such that the sliders can be locked against movement in the fully closed position on the interlocking rows of fastener elements. These sliders, however, have originally been developed for use on fasteners applied to plackets and other closure openings in garments, bags and the like. In the sliders of both known types a locking pawl is provided which is actuated by the pull tab into and out of engagement with the fastener elements in the guide channel in the slider body.

The slide fasteners incorporating such conventional sliders are therefore readily openable, after having been closed, by manipulating the pull tab in the usual manner. Thus, when such fasteners are applied to openings in upholstery coverings of chairs and the like, they may be opened, for example, by children out of curiosity. This is undesirable since then the rubber sponge or like filling material within the coverings can be easily taken out.

SUMMARY OF THE INVENTION

It is an object of this invention to provide a fastener slider designed specifically for the application under consideration, such that the slider can be semipermanently locked in a closed position on interlocking rows of fastener elements or scoops.

Briefly stated, the invention is directed to a device for semipermanently locking a slider of the type having a pair of inerconnected wings defining therebetween a guide channel for rows of fastener elements. The device comprises a locking pawl formed substantially integral with one of the wings of the slider, the locking pawl being generally directed rearwardly of the slider and at least partly arranged at an angle to the wing for engagement with the fastener elements in the closed position of the slider thereon so as to lock the latter against movement in the fastener opening direction.

The slider may be equipped with a pull tab, but the locking pawl is in no way related to the pull tab in performing the desired locking function. Once the locking pawl engages the fastener elements in the closed position of the slider, the fastener is not openable by usual manual effort exerted on the pull tab or body of the slider, because the slider is movable in the fastener opening direction only when its locking pawl is severed or otherwise forced out of engagement with the fastener elements. There is accordingly practically no possibility of the fastener to be opened by children.

The above and other objects and advantages of the invention will become apparent from the following description of several preferred embodiments, with reference had to the accompanying drawings in which like reference characters refer to like parts throughout the several views.

DESCRIPTION OF THE PREFERRED EMBODIMENTS

Figure 2:
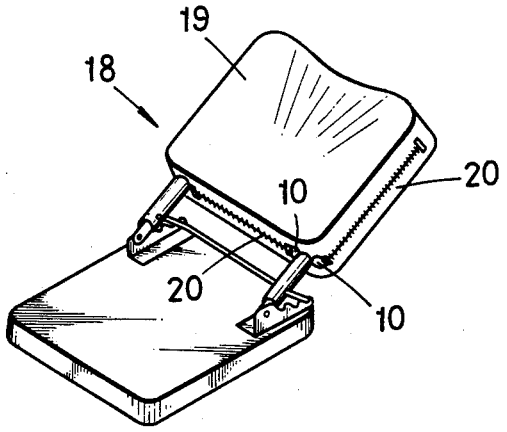
FIG. 2 is a perspective view explanatory of one possible application of slide fasteners incorporating the sliders according to this invention, the fasteners being shown applied to openings in the covering of an upholstered back of a chair.
Figure 1:
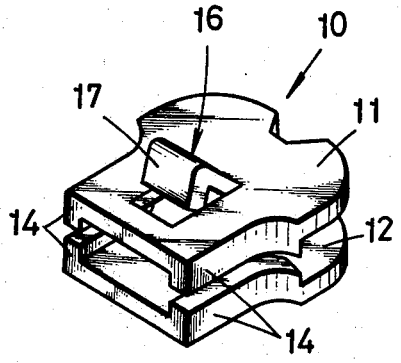
FIG. 1 is a perspective view of a semipermanently lockable slider constructed in accordance with this invention.
Figure 3:
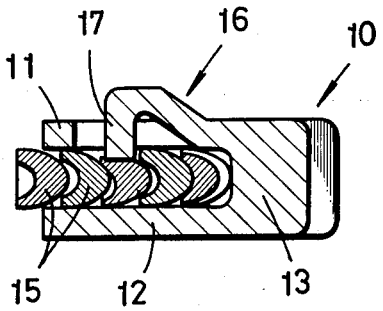
FIG. 3 is a section along the central longitudinal axis of the slider of FIG. 1, the view being explanatory of the way the locking pawl of the slider engages the fastener elements in the closed position of the slider.

The semipermanently lockable slider according to this invention is shown in its first preferred form in FIGS. 1 to 3. With particular reference to FIG. 1, the illustrated slider 10 comprises a pair of similar wings 11, 12 interconnected at their front ends by a neck or web 13 (FIG. 3). Each wing is provided with a pair of marginal guide flanges 14 which cooperate with the neck 13 to form a forwardly diverging, generally Y-shaped guide channel between the wings 11 and 12 for guiding interlockable rows of fastener elements 15 progressively into and out of interlocked relation in the well known manner.

For semipermanently locking the slider 10 in its fully closed position on the rows of fastener elements 15, a locking pawl 16 is formed integrally with one of the wings, 11 for example, of the slider. In this particular embodiment of the invention, the locking pawl 16 is arranged substantially centrally of the wing 11 and is formed by making cuts in the wing and by bending a part of this wing into inverted V-shaped configuration as viewed from one side of the slider.

The locking pawl 16 as a whole is directed rearwardly of the slider and includes a portion 17 arranged at such an angle to the wing 11 as to make positive engagement with the fastener elements 15 in the closed position of the slider for locking the latter against movement in the fastener opening direction.

FIG. 2 is an illustration of a possible application of the slider 10 of the foregoing construction. The reference numeral 18 generally designates a chair having an upholstered back 19 but no legs and intended to be squatted on, such chair being used extensively on "tatami" or straw matting employed as a floor covering in Japanese homes. The upholstered back 19 of the chair 18 is shown to have slide fasteners 20 which include the sliders 10 according to this invention. After filling the interior of this chair back 19 with rubber sponge or any other desired material, the slide fasteners 20 are closed by pulling the sliders 10 along the rows of fastener elements 15 to the illustrated closed positions thereon by use of a suitable tool.

Then, as illustrated in FIG. 3, the locking pawl 16 of each slider 10 is depressed, as by means of a pair of pincers, into the guide channel of the slider for engagement with the fastener elements received therein. The slider is now locked in the closed position against any possibility of movement in the fastener opening direction.

Figure 4:
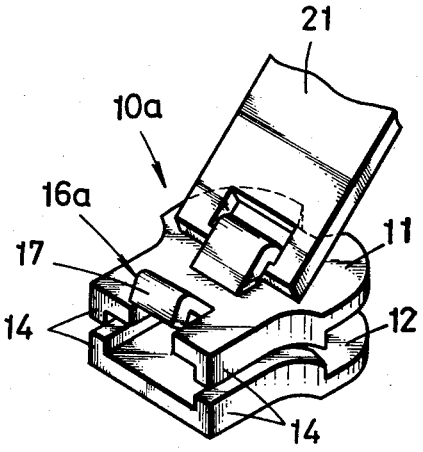
FIG. 4 is a perspective view of another preferred embodiment of the invention, with the pull tab shown fragmentarily.

A slider 10*a* shown in FIG. 4 by way of another preferred embodiment of the invention differs from the slider 10 of the preceding embodiment in that its wing 11 has the usual pull tab 21 pivotally coupled thereto. Also, a locking pawl 16*a* of the slider 10*a* is arranged at the rear end of the wing 11, instead of being arranged centrally of the wing as in the preceding embodiment. Other details of construction and operation are exactly as set forth in the foregoing with reference to FIGS. 1 to 3. It should be appreciated that the locking pawl 16*a* is capable of performing the desired locking function completely independently of the pull tab 21.

Figure 5:
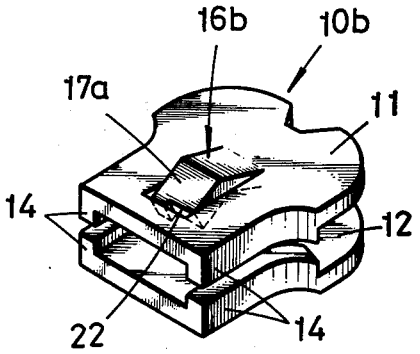
FIG. 5 is a perspective view of a modification of the slider of FIG. 1.
Figure 6:
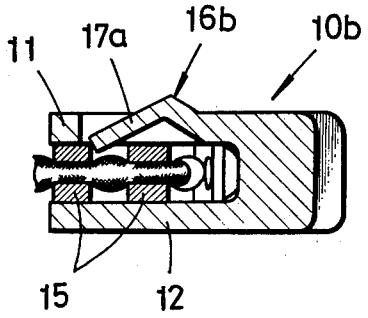
FIG. 6 is a section along the central longitudinal axis of the slider of FIG. 5, the view being explanatory of the way the locking pawl of the slider engages the fastener elements in the closed position of the slider.

FIGS. 5 and 6 illustrate a slight modification of the FIGS. 1 to 3 embodiment, in which a locking pawl 16*b* is so formed on the wing 11 of a slider 10*b* that its portion 17*a* partly intrudes into the guide channel between the wings 11 and 12. The locking pawl 16*b* also differs from the preceding locking pawls 16 and 16*a* in that its portion 17*a* is recessed at 22.

During the fastener closing movement of the slider 10*b*, the locking pawl 16*b* will slide over and engage resiliently with the fastener elements 15 as they progressively pass through the guide channel in the slider for interlocked relation. In the fully closed position of the slider 10*b*, the locking pawl 16*b* will have its portion 17*a* caught automatically between the adjacent elements of the interlocked rows in the guide channel, as depicted in FIG. 6. The slider 10*b*, therefore, can be locked in its closed position against movement in the fastener opening direction without having its locking pawl 16*b* forced into the guide channel.

Figure 7:
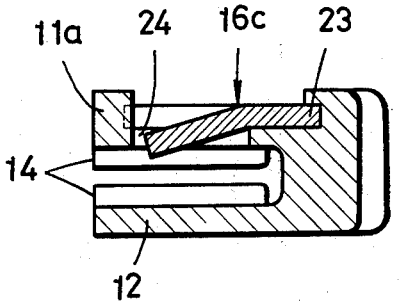
FIG. 7 is a similar sectional view of a further embodiment of the invention.

FIG. 7 is given merely to illustrate the fact that the locking pawl according to the invention can be formed separately and later suitably affixed to the slider, into substantially integral relationship thereto. In FIG. 7, a separately formed locking pawl 16*c* is secured at one end 23 to the wing 11*a* of a slider 10*c* and has the other end arranged for engagement with the fastener elements through an aperture 24 formed in the wing.

while the semipermanently lockable slider according to this invention has been shown and described hereinbefore in its several preferred forms, it is, of course, understood that the invention itself is not to be restricted by the exact details disclosed herein but is inclusive of many modifications comprehended within the scope of the following claims.

What is claimed is:

1. In a slider movable along interlockable rows of fastener elements of a slide fastener for closing the latter, wherein the slider includes a pair of upper and lower wings, a neck portion interconnecting the wings at their front ends to define a generally Y-shaped guide channel between the wings for guiding the interlockable rows of fastener elements therethrough, said upper wind including an aperture therethrough and a device for locking the slider in a closed position on the rows of fastener elements, said device consisting of a resilient locking pawl formed substantially integral with one of the wings of the slider and connected to an end edge of said aperture and having a distal end portion directed toward the rear end of said slider, said locking pawl being disposed centrally of said one wing and rearwardly of the neck portion, said locking pawl extending upwardly from its connection to said upper wing a slight amount having its distal end portion positioned at an acute angle to said one wing and intruding through said aperture into the guide channel to permit the distal end tip of said locking pawl to lockingly engage at least one fastener element within the guide channel in the closed position of the slider so as to lock the latter against movement in the fastener opening direction, said locking pawl being independently bendable relative to said one wing from a release configuration out of engagement with said fastener element within the guide channel to a fixed locking position of engagement with said fastener element, said distal end tip of the locking pawl being disposed for resilient engagement with said fastener elements and for sliding over said fastener elements during the fastener closing movement of the slider, when in said locking position the major portion of said locking pawl being disposed below the outward surface of said one wing to shield said locking pawl against movement toward said release configuration by forces acting above said outward surface of said one wing.

* * * * *